US009765543B2

(12) United States Patent
Hodak

(10) Patent No.: US 9,765,543 B2
(45) **Date of Patent: *Sep. 19, 2017**

(54) SWIMMING POOL FLOW DIVERTING WEIR

(71) Applicant: Jerry Hodak, Zelienople, PA (US)

(72) Inventor: Jerry Hodak, Zelienople, PA (US)

( * ) Notice: Subject to any disclaimer, the term of this patent is extended or adjusted under 35 U.S.C. 154(b) by 141 days.

This patent is subject to a terminal disclaimer.

(21) Appl. No.: 14/533,508

(22) Filed: Nov. 5, 2014

(65) Prior Publication Data

US 2016/0123030 A1 May 5, 2016

(51) Int. Cl.
*E04H 4/12* (2006.01)

(52) U.S. Cl.
CPC ..... *E04H 4/1254* (2013.01); *E04H 4/1272* (2013.01)

(58) Field of Classification Search
CPC ..... E04H 4/1254; E04H 4/1272
USPC ..... 210/167.1, 167.18, 232
See application file for complete search history.

(56) References Cited

U.S. PATENT DOCUMENTS

| | | | | |
|---|---|---|---|---|
| 3,152,076 A | | 10/1964 | Kreutzer | |
| 4,140,634 A | | 2/1979 | Harry | |
| 4,369,109 A | | 1/1983 | Edge | |
| 4,379,749 A | | 4/1983 | Roth | |
| 4,734,189 A | | 3/1988 | Page, Jr. | |
| 4,904,379 A | * | 2/1990 | Ward | E04H 4/1254 134/167 R |
| 5,059,314 A | | 10/1991 | Beckman | |
| 5,391,296 A | | 2/1995 | Rotundo et al. | |
| 5,392,472 A | | 2/1995 | Maxfield | |
| 5,510,020 A | * | 4/1996 | Gronlund | E04H 4/1254 210/167.18 |
| 5,525,217 A | * | 6/1996 | Fulop | E04H 4/1254 210/167.18 |
| 5,753,113 A | | 5/1998 | Hendricks | |
| 5,804,064 A | * | 9/1998 | Desrochers | E04H 4/1254 210/167.18 |
| 6,315,911 B1 | | 11/2001 | Radsky | |
| 7,005,063 B2 | | 2/2006 | Hodak | |
| 7,390,402 B1 | | 6/2008 | Rhoades, Sr. | |
| 8,282,416 B2 | * | 10/2012 | Imazu | H01R 12/51 439/607.04 |

FOREIGN PATENT DOCUMENTS

CA 2131320 A1 * 2/1996

OTHER PUBLICATIONS

Confer Plastics Inc., Skim-It, Printed in U.S.A., Publication Date Unknown.

* cited by examiner

*Primary Examiner* — Fred Prince
(74) *Attorney, Agent, or Firm* — James Ray and Assoc. LLC

(57) ABSTRACT

A flow diverting weir device includes a mounting member engageable with surface(s) of a skimmer opening of a swimming pool skimmer and an elongated arm having one end thereof connected to the mounting member and extendable outwardly from the skimmer opening. The mounting member may be integrated into the surface(s) of the skimmer opening. The mounting member may include suction cup(s).

19 Claims, 10 Drawing Sheets

20

SWIMMING POOL FLOW DIVERTING WEIR

CROSS-REFERENCE TO RELATED APPLICATIONS

N/A

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND

1. Technical Field

The subject matter relates to swimming pools. It further relates to a flow diverting weir for a swimming pool skimmer.

2. Description of Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, water filtration and circulation systems for above ground or in ground pools include skimmer baskets with openings provided in a sidewall of such pools to evacuate floating debris, for example such as objects and contaminants. The opening in a conventional skimmer is substantially co-planar with the pool sidewall and draws surface water into the skimmer body, mainly as a function of the power of the pump motor. To increase the efficiency of surface cleaning and removal of floating debris, flow diverting weirs are being used.

Some traditional flow diverting weirs of a rigid construction may be attached, for example by a snap action, to a specially-formed peripheral edge of skimmer face plate. Some traditional flow diverting weirs may include an enclosed scoop member having an opening on one side to allow entry of water from the pool into the skimmer opening, further having a lower peripheral edge which carries flexible lip for attachment to the flange of the skimmer face plate, a surface carrying slot and additionally having an elongated rigid paddle removably received in the slot and being adapted to extend outwardly into the pool. Some traditional flow diverting weirs may include a mounting bracket with a length adjusting nuts and a mail spline to receive a female end of the weir blade. Some traditional flow diverting weirs may include a mounting bracket with upper and lower bracket housings, each of the housings having a bore, that is removably attached to a skimmer inlet opening of the swimming pool filtration system and a diverter releasably attached to a mounting bracket and including upper and lower diverter housings each diverter housing having an upwardly extending pin that is received within a respective bracket housing. Other traditional flow diverting weirs may include hinged connections by way of suction cups and a brace to hold the weir arm in an operative position.

However, there is a need for additional and improved flow diverting weirs for a swimming pool skimmer that are cost effective to manufacture and are easy to install and adjust without special tools.

BRIEF DESCRIPTION OF THE DRAWINGS

The accompanying drawings are incorporated in and constitute part of the specification and illustrate various embodiments. In the drawings.

DESCRIPTION OF EXEMPLARY EMBODIMENTS

Figure 1:
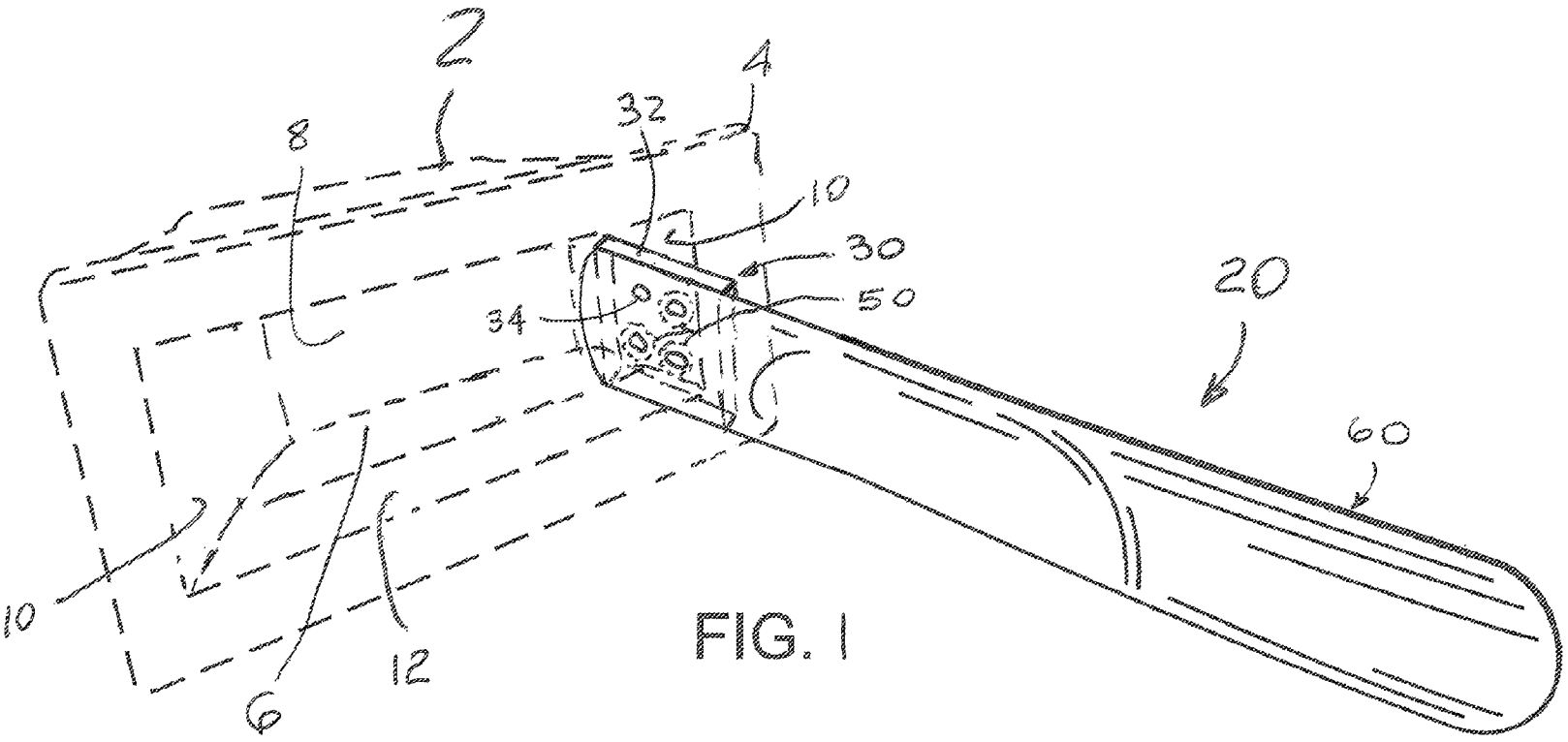
FIG. 1 illustrates a perspective view of one exemplary embodiment of a flow diverting weir.

Prior to proceeding to the more detailed description of the present invention, it should be noted that, for the sake of clarity and understanding, identical components which have identical functions have been identified with identical reference numerals throughout the several views illustrated in the drawing figures.

The following detailed description is merely exemplary in nature and is not intended to limit the described examples or the application and uses of the described examples. As used herein, the words "example", "exemplary" or "illustrative" means "serving as an example, instance, or illustration." Any implementation described herein as "example", "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," "exterior," "interior," and derivatives thereof shall relate to the invention as oriented in the Figures. Furthermore, there is no intention to be bound by any expressed or implied theory presented in the preceding technical field, background, or the following detailed description. It is also to be understood that the specific devices and processes illustrated in the attached drawings, and described in the following specification, are simply examples of the inventive concepts defined in the appended claims. Hence, specific dimensions and other physical characteristics relating to the examples disclosed herein are not to be considered as limiting, unless the claims expressly state otherwise.

The particular exemplary embodiments of the present disclosure generally provide devices and methods directed to a flow diverting weir configured to divert floating debris into a skimmer opening of above ground or in ground pools or prevent flow of debris into the skimmer opening.

The particular exemplary embodiments of the present disclosure further provide a flow diverting weir device comprising a mounting member sized for insertion into an opening of a pool skimmer and an elongated arm at least temporarily attached to the mounting member and extending in a direction generally normal to the plane of the pool skimmer opening during use of the flow diverting weir device.

In particular exemplary embodiments, the mounting member is attached to a vertical surface of the pool skimmer opening.

In particular exemplary embodiments, the mounting member is retained between the opposite horizontal surfaces of the pool skimmer opening.

In particular exemplary embodiments, the mounting member is provided integral with a vertical surface of the pool skimmer opening.

The particular exemplary embodiments of the present disclosure additionally provide a flow diverting weir device comprising an elongated arm at least temporarily attached to a surface of the pool skimmer opening and extending outwardly therefrom during use of the flow diverting weir device.

FIG. 1 illustrates an exemplary embodiment of a pool skimmer basket 2 that has a frame 4 and an opening 6 defining an interior rear surface 8 that may be curved or straight, a pair of opposite vertical surfaces 10 and a pair of opposite horizontal surfaces 12.

FIG. 1 further illustrates one exemplary embodiment of the flow diverting weir device 20 that comprises a mounting member 30 releaseably attachable to the vertical surface 10 of the skimmer opening 6 of the swimming pool skimmer 2 and an elongated arm 60 having one end thereof connected to the mounting member 30 and extendable outwardly from the skimmer opening 6. At least one suction cup 50 is illustrated as being directly attached or connected to a body 32 of the mounting member 30, although indirect attachment or connection is also contemplated herewithin. The at least one suction cup 50, also sometimes known as a sucker, includes a cup shaped working portion 52 that uses negative fluid pressure of air or water to produce partial vacuum and to adhere to nonporous surfaces and in the process creates a partial vacuum. The suction cup 50 may further include a base portion 54 extending from an apex of the working portion 52.

Figure 2:
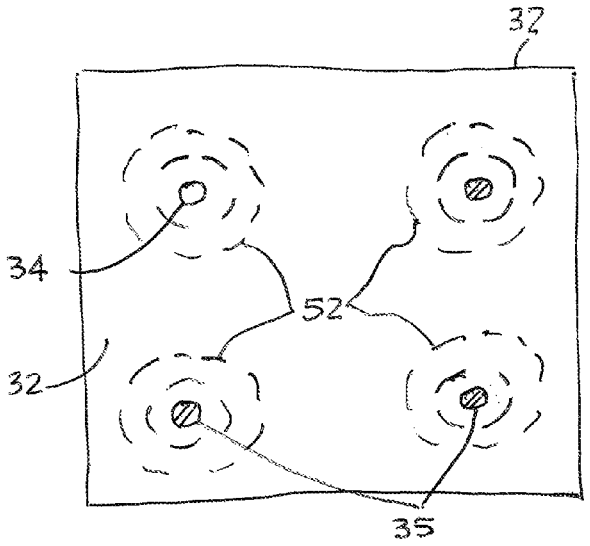
FIG. 2 illustrates a front view of another example of the flow diverting weir.
Figure 3:
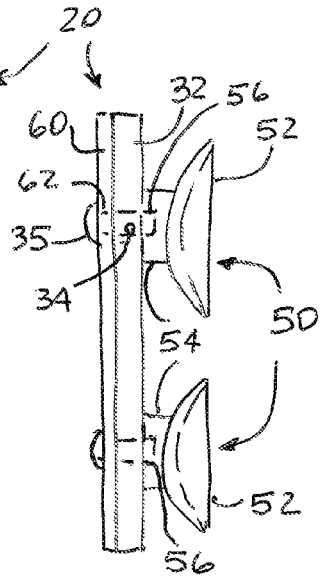
FIG. 3 illustrates an end view of the flow diverting weir of FIG. 2.
Figure 4:
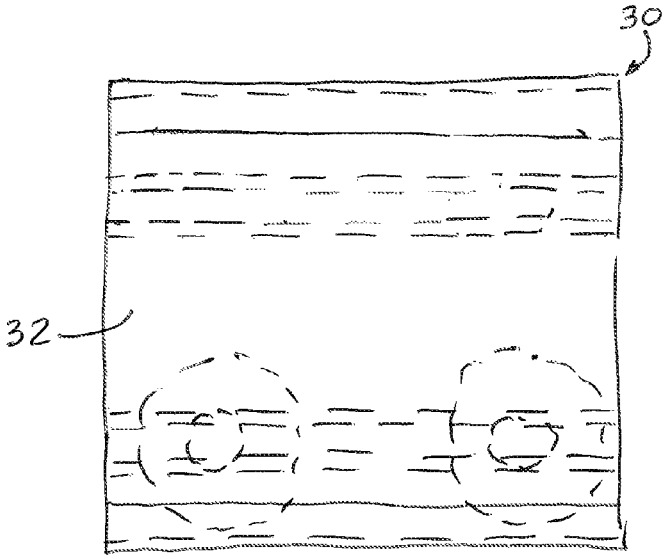
FIG. 4 illustrates a front view of yet another example of the flow diverting weir.
Figure 5:
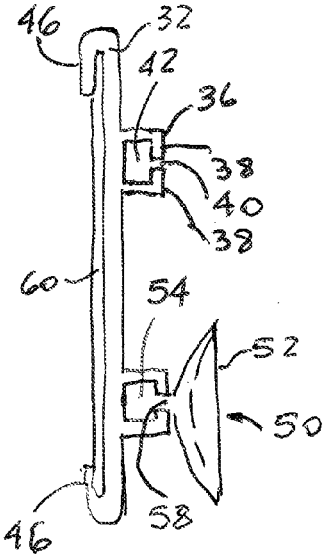
FIG. 5 illustrates an end view of the flow diverting weir of FIG. 1.

In one example of FIGS. 2-3, the base portion 54 may be provided with an axial bore 56 and the body 32 of the mounting member 30 may be adapted with at least one aperture 34 formed through a thickness thereof, wherein base portion 54 is attached to the body 32 by way of fastener 35 passed through the at least one aperture 34 and received within the axial bore 56. The fastener 35 may be a threaded screw or bolt. The fastener 35 may be a threaded stud extending outwardly from the base portion 54. The working portion 52 will be then operable to adhere to the vertical surface 10. The specific vertical surface 10 is selected based on the water flow direction. Thus, the flow diverting weir device 20 may be flipped 180 degrees and be easily repositioned depending on the water flow direction.

In another example of FIGS. 4-5 and 15-21, the base portion 54 can be provided with a peripheral groove 58 formed therewithin. The body 32 may be then provided with one or more channels 36 disposed on a surface of the body 32 facing the vertical surface 10 of the skimmer 2 during use of the flow diverting weir device 20 and having a pair of inturned flanges 38 defining an opening or passageway 40 between the edges of the inturned flanges 38 and a generally hollow interior 42. The one or more channels 36 are shaped and sized so that the base portion 54 is inserted into the hollow interior 42 and the inturned flanges 38 are lodged within the peripheral groove 58 so that the suction cup 50 is prevented from unintentional movement from the one or more channels 36. In the example of FIGS. 4-5 and 15-21, the at least one suction cup 50 are four suction cups 50, wherein the one or more channels 36 are two channels 36 disposed in a spaced apart parallel relationship with each other and wherein the base portions 54 of two suction cups 50 are inserted into each channel 36 during use of the flow diverting weir device 20.

The elongated arm 60 may be attached, at least temporarily, to the mounting member 30 in a number of different ways. In one example of FIGS. 2-3, the elongated arm 60 may have one end thereof connected to the body 32 by way of aperture(s) 62 formed through a thickness of the elongated arm 60 and aligned with apertures 32 and fastened to the body 32 with the above described fastener(s) 35. In a further example of FIGS. 4-5, the mounting member 30 may comprise a pair of spaced apart flanges 46 disposed on one surface of the body 32 adjacent opposite edges thereof and forming a gap with the surface of the body 32, the pair of spaced apart flanges 46 are shaped to receive a width of the elongated arm 60 therewithin. In this example, the elongated arm 60 is movable along the surface of the mounting member 30 into and from the skimmer opening 6 so that the length of the elongated arm 60 extending outwardly from the skimmer opening 6 may be adjusted. The overall length of the elongated arm 60, particularly manufactured from a flexible material, may be so selected that the elongated arm 60 is disposed, either completely or partially, within the opening 6 so that the user does not have to be concerned with protrusion of the elongated arm 60 into the interior of the pool (not shown) when the flow diverting weir device 20 is not in use. It is also contemplated that the flanges 46 may be spaced inwardly from a respective edge of the body 32.

In another example, the flanges 46 may be upset, mechanically or by application of heat and force to crimp the surface portion of the elongated arm 60 to the surface of the body 32 to provide a permanent attachment of the elongated arm 60 to the mounting member 30.

FIGS. 15-21 also illustrate (when presented in a conjunction with the relevant Brief Description of the Drawings) an ornamental design for a flow diverting weir. The claimed flow diverting weir can be used in pool skimmers for either diverting flow of debris into the skimmer opening or preventing flow of such debris into the skimmer opening.

Figure 17:
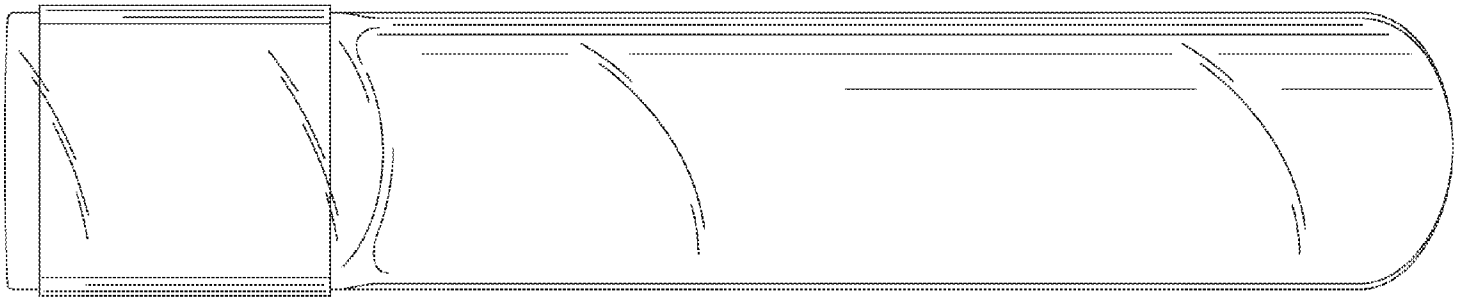
FIG. 17 illustrates a front view of the flow diverting weir in FIG. 15.
Figure 18:
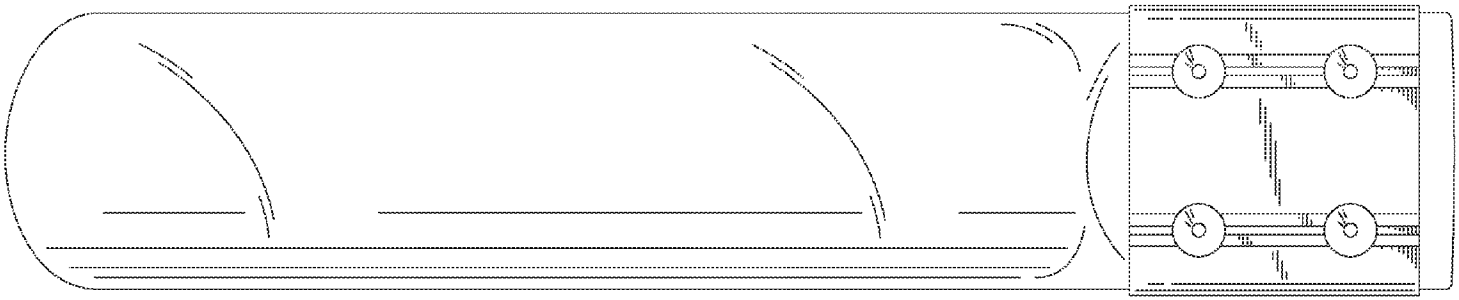
FIG. 18 illustrates a rear view of the flow diverting weir in FIG. 15.
Figure 20:
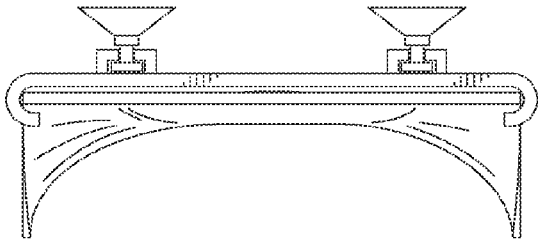
FIG. 20 illustrates a right side view of the flow diverting weir in FIG. 15.
Figure 19:
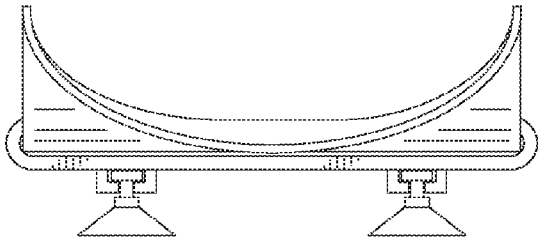
FIG. 19 illustrates a left side view of the flow diverting weir in FIG. 15.
Figure 21:
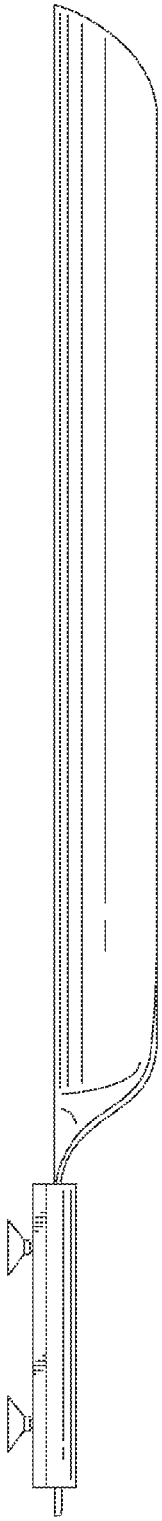
FIG. 21 illustrates a top view or a bottom view of the flow diverting weir in FIG. 15.

Each terminal end of the elongated arm 60 may be either curved as is shown, for example, on the right side in FIG. 17 or a generally straight, is shown, for example, on the left side in FIG. 17. Or, as illustrated in the example of FIGS. 15-18 and 21, the elongated arm 60 includes a combination of both curved and generally straight terminal ends.

The elongated arm 60 being illustrated in FIGS. 15-21 as manufactured from a transparent (light transmissive, light permeable, clear, translucent) material may be also manufactured from a non-transparent, light resistant material.

Figure 6:
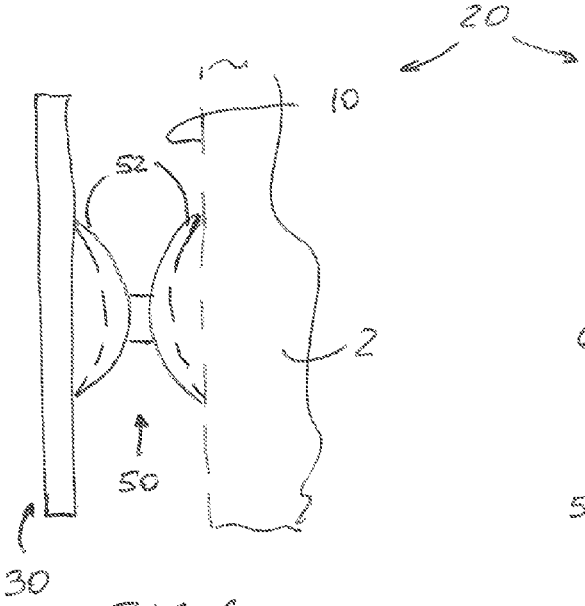
FIG. 6 illustrates one exemplary end view of the flow diverting weir of FIG. 1.
Figure 7:
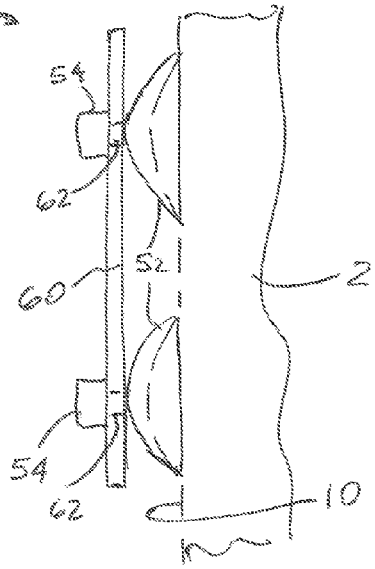
FIG. 7 illustrates another exemplary end view of the flow diverting weir of FIG. 1.

It would be well understood that the mounting bracket 30 may be omitted in the exemplary embodiment of FIGS. 15-21 with the suction cups 50 being attached directly to the elongated arm 60 in accordance with illustrations in FIGS. 6-7. Furthermore, the flanges 46 and/or the channels 36 may be omitted in the exemplary embodiment of FIGS. 15-21, with the elongated arm 60 attached to the mounting bracket 30 in accordance with illustrations in FIGS. 2-3.

Although the elongated arm 60 is illustrated as having one end thereof in a close proximity to an edge of the mounting bracket 30, such one end can be positioned at any distance so as to adjust the length portion of the elongated arm 60 extending outwardly from the skimmer opening 6.

In another example of FIG. 6, the at least one suction cup 50 has a pair of working portions 52, wherein one of the pair of working portion 52 is adhered to a surface of the body 32 and wherein an opposite one of the pair of working portion 52 is adhered to the surface 10 of the skimmer opening 6 during use of the flow diverting weir device 20.

In another exemplary embodiment, the elongated arm 60 may be attached or connected to the vertical surface 10 without the use of the body 32 of the mounting member 30. FIG. 7 illustrates one example wherein the elongated arm 60 includes the above described aperture(s) 62 formed through the thickness thereof, wherein the at least one suction cup 50 has the base portion 54 thereof passed, under compression, through the at least one aperture 62 so that the thickness of the elongated arm 60 is lodged within the peripheral groove 58. The working portion 52 of the suction cup 50 is then adhered to the vertical surface 10 of the skimmer opening 6 during use of the flow diverting weir device 20. It is also contemplated that the suction cup 50 may be attached to the elongated arm 60 with the above described fastener 35 passed through the aperture 62. In either example, the suction cup 50 is attached directly to the elongated arm 60. When required more than two or more than four apertures 62 may be provided so as to adjust the length portion of the elongated arm 60 extending outwardly from the skimmer opening 6. For example, two rows of six apertures 62 each can be spaced apart along the length of the elongated arm 60, providing five temporarily fixed positions to set the length of the elongated arm 60 extending outwardly from the skimmer opening 6.

In another exemplary embodiment, the mounting member 30 may be integrated into one or both vertical surfaces 10 of the skimmer opening 6.

Figure 8:
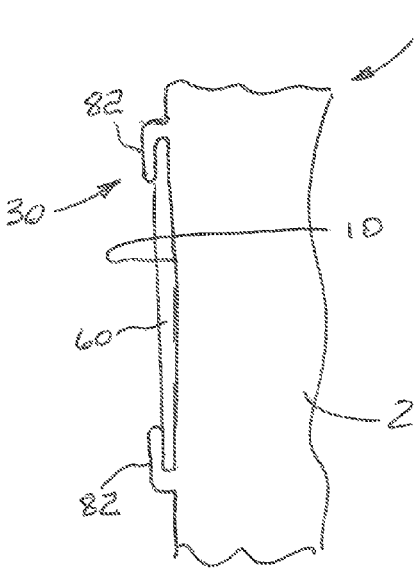
FIG. 8 illustrates yet another exemplary end view of the flow diverting weir of FIG. 1.

In one example of FIG. 8, the mounting member 30 comprises a pair of flanges 82 disposed in a spaced apart relationship with each other on the surface 10 of the skimmer opening 6, the pair of flanges 82 are positioned, shaped and sized to receive a width of the elongated arm 60 therewithin. The flanges 82 may be identical to the above described flanges 46. The flanges 82 may be provided integral to the surface 10 during manufacturing of the skimmer 2.

In another example, the at least one suction cup 50 may have a base portion 54 thereof attached to the vertical surface 10 of the skimmer opening 6 and the working portion 52 thereof adhered directly to a surface of the arm 60 during use of the flow diverting weir device 20. In yet another example, the suction cup 50 may be provided with dual working portions 52 of FIG. 6

Figure 9:
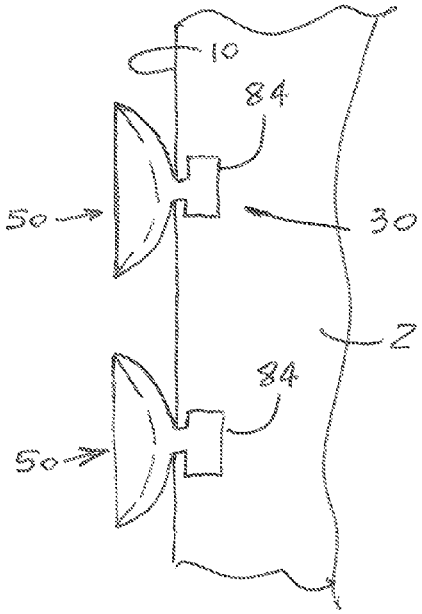
FIG. 9 illustrates a further exemplary end view of the flow diverting weir of FIG. 1.

In another example of FIG. 9, the mounting member 30 comprises a pair of channels 84 disposed in a spaced apart relationship with each other on or within the surface 12 of the skimmer opening 6, and two or more suction cups 50 having working portion 52 thereof adhered to the surface of the elongated arm 60 and base portions 54 thereof received within the pair of channels 84 during use of the flow diverting weir device 20. The channels 84 may be identical, in their construction, to the above described channels 36. The channels 84 may be provided integral to the surface 10 during manufacturing of the skimmer 2.

Figure 10:
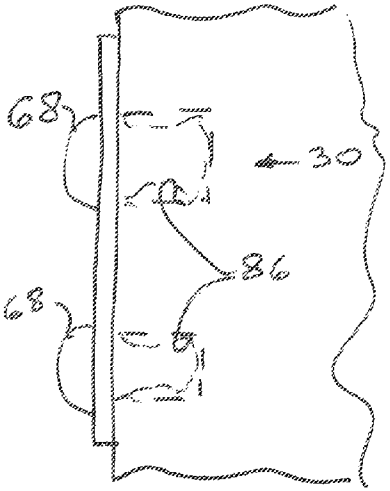
FIG. 10 illustrates another exemplary end view of the flow diverting weir of FIG. 1.

In another example of FIG. 10, the mounting member 30 includes bore(s) 86 in the vertical surface(s) 10 of the skimmer opening 6, plug(s) 68 passed through aperture(s) 62 in the elongated arm 60 so as to at least temporarily attach or connect the elongated arm 60 to the surface(s) 10.

In another exemplary embodiment the mounting member 30 may be caged between the horizontal surfaces 12 of the skimmer opening 6.

Figure 11:
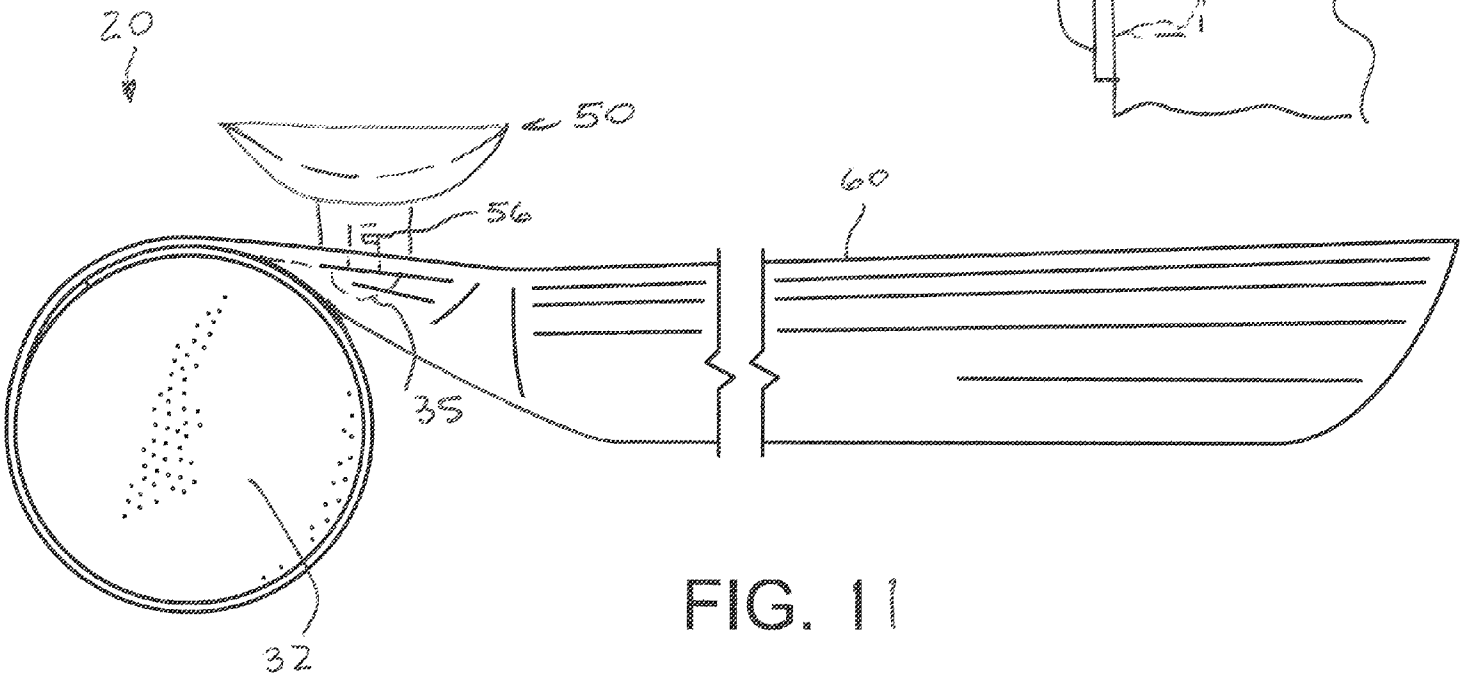
FIG. 11 illustrates a top view of another exemplary embodiment of the flow diverting weir.

In one example of FIG. 11, the elongated arm 60 is attached to a mounting member 30 having the body 32 manufactured from a compressible and resilient material and wherein the flow diverting weir device 20 further includes the suction cup 50 fastened to the elongated arm 60.

Figure 12:
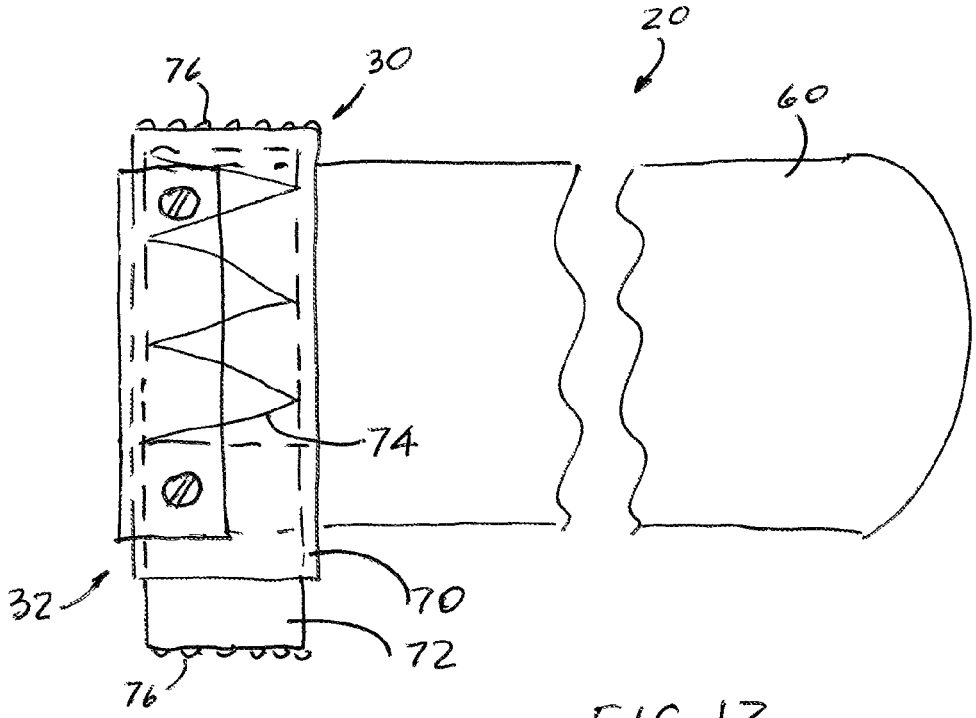
FIG. 12 illustrates a top view of yet another exemplary embodiment of the flow diverting weir.

In another example of FIG. 12, the body 32 of the mounting member 30 may include a pair of telescopically movable portions 70 and 72 and a bias member 74, such as a coil spring or a resilient elastomeric member, biasing the pair of telescopically movable portions for engagement with opposite surfaces 12 of the skimmer opening 6 during use of the flow diverting weir device 20. The terminal end surfaces of the members 70, 72 may be provided with projections 76 so as to further enhance retention of the mounting member 30 during use of the flow diverting weir device 20.

The elongated arm 60 has one end thereof attached to one of the pair of telescopically movable portions 70, 72 and may be manufactured from a flexible material sufficient to move the elongated arm 60 between a coiled position, wherein the elongated arm 60 is wrapped around a peripheral surface of the one of the pair of telescopically movable portions 70, 72 and an uncoiled position, wherein the elongated arm 60 extends outwardly from the skimmer opening 6.

Figure 13:
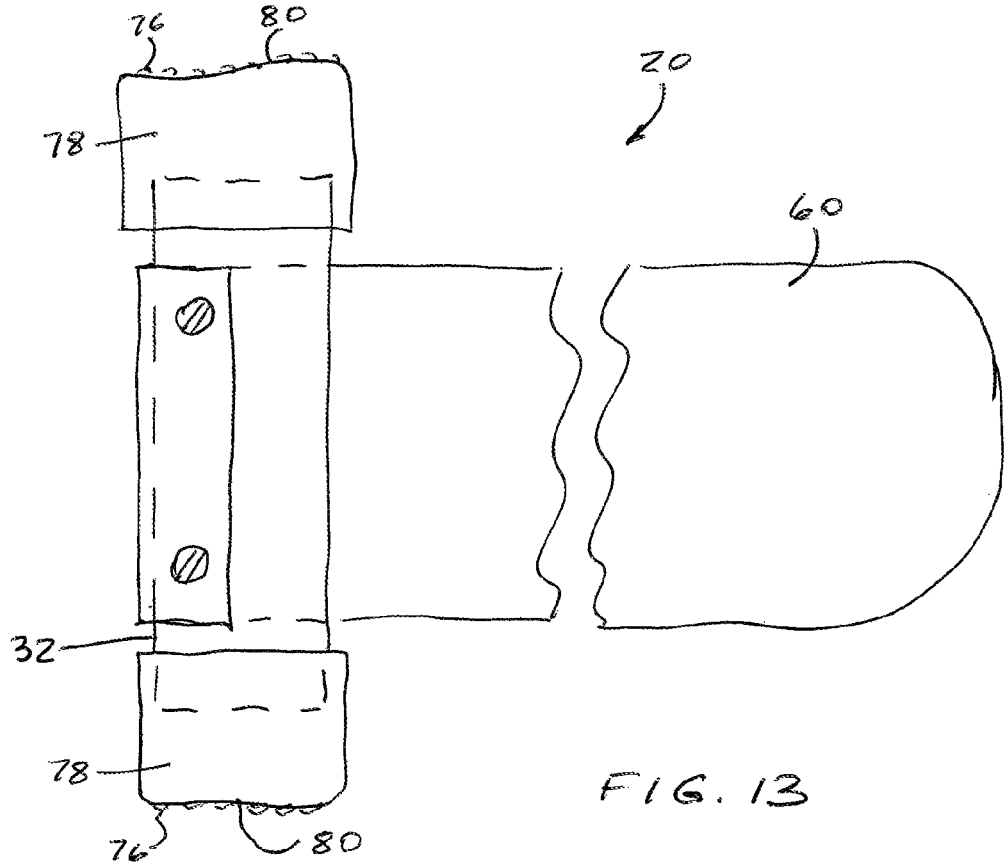
FIG. 13 illustrates a top view of a further another exemplary embodiment of the flow diverting weir.

In another example of FIG. 13, the body 32 may be provided as having an elongated shape and wherein the mounting member 30 further includes a pair of resilient elastomeric members 78 terminating opposite ends of the body 32 and abutting opposite surfaces 12 of the skimmer opening 6 during use of the flow diverting weir device 20 and wherein the elongated arm 60 has one end thereof attached to the body 32, for example by way of fasteners 64. Furthermore, the arm 60 may be manufactured from a flexible material sufficient to move the arm 60 between a coiled position, wherein the arm 60 is wrapped or coiled around a peripheral surface of the body 32 and an uncoiled position, wherein the arm 60 extends outwardly from the skimmer opening 6. Thus, the elongated arm 60 may be stored within the opening 6 when the flow diverting weir device 20 is not in use.

The terminal end surfaces 80 of the resilient elastomeric members 78 may be provided with the above described projections 76 to further enhance retention of the mounting member 30 during use of the flow diverting weir device 20.

In either of the above described examples, the elongated arm 60 may include an arcuate cross-section in a plane normal to the length thereof.

In either of the above described examples, the elongated arm 60 may be manufactured from a material being sufficiently flexible to wrap or coil around a peripheral surface of the mounting member 30 or follow a curved interior surface 8 of the skimmer 2 and being sufficiently resilient to divert floating debris into the skimmer opening 6 while the elongated arm 60 extends outwardly from the skimmer opening 6. Such flexible material may be butyrate or polycarbonate material and may be 0.040 thick. In either of the above described examples, the flexible elongated arm 60 may be extruded, particularly when provided with a curved shape. In either of the above described examples, the end of the elongated arm 60 inserted into the skimmer opening 6 flattens to connect or attach to the surface (s) thereof.

In either of the above described examples, the elongated arm 60 may be manufactured from a rigid material and may further include the above described channel(s) 36, 82 so as to receive the base portion 52 of the suction cup(s) 50.

In either of the above described examples, the elongated arm 60 is supported sufficiently so as to extend outwardly from the skimmer opening 6 and guide debris into the skimmer opening 6 without the need for additional braces, even when the elongated arm 60 is manufactured from the above described flexible material.

In the above described examples of FIGS. 4-6 and 8-9, a length of the elongated arm 60 extending outwardly from the skimmer opening 6 during use of the flow diverting weir device 20 can be adjusted without use of tools or fasteners by simply manipulating the a length of the elongated arm 60 disposed within the skimmer opening 6. In the above described examples of FIGS. 12-13, a length of the elongated arm 60 extending outwardly from the skimmer opening 6 during use of the flow diverting weir device 20 can be adjusted by selectively coiling or wrapping the elongated arm 60 around the mounting bracket 30.

In another exemplary embodiment, the present disclosure provides a method of diverting floating debris into the opening 6 of the skimmer 2. The method comprises the step of attaching an elongated arm 60 of the flow diverting weir device 20 to one or several surfaces of the skimmer 2. In some examples, the method may comprise a step of attaching the elongated arm 60 to the surface(s) of the skimmer opening 6 by way of the mounting member 30 and suction cup(s) 50. In some of the above examples, the method may comprise a step of attaching the elongated arm 60 directly to the surface(s) of the skimmer opening 6 with the suction cup(s) 50 but without the mounting member 30. In some of the above examples, the method may comprise a step of attaching the elongated arm 60 directly to the surface of the skimmer opening 6 with the plug(s) 86. In some of the above examples, the method may comprise a step of attaching the elongated arm 60 into a channel provided by a pair of flanges on the surface of the skimmer opening 6.

Figure 14:
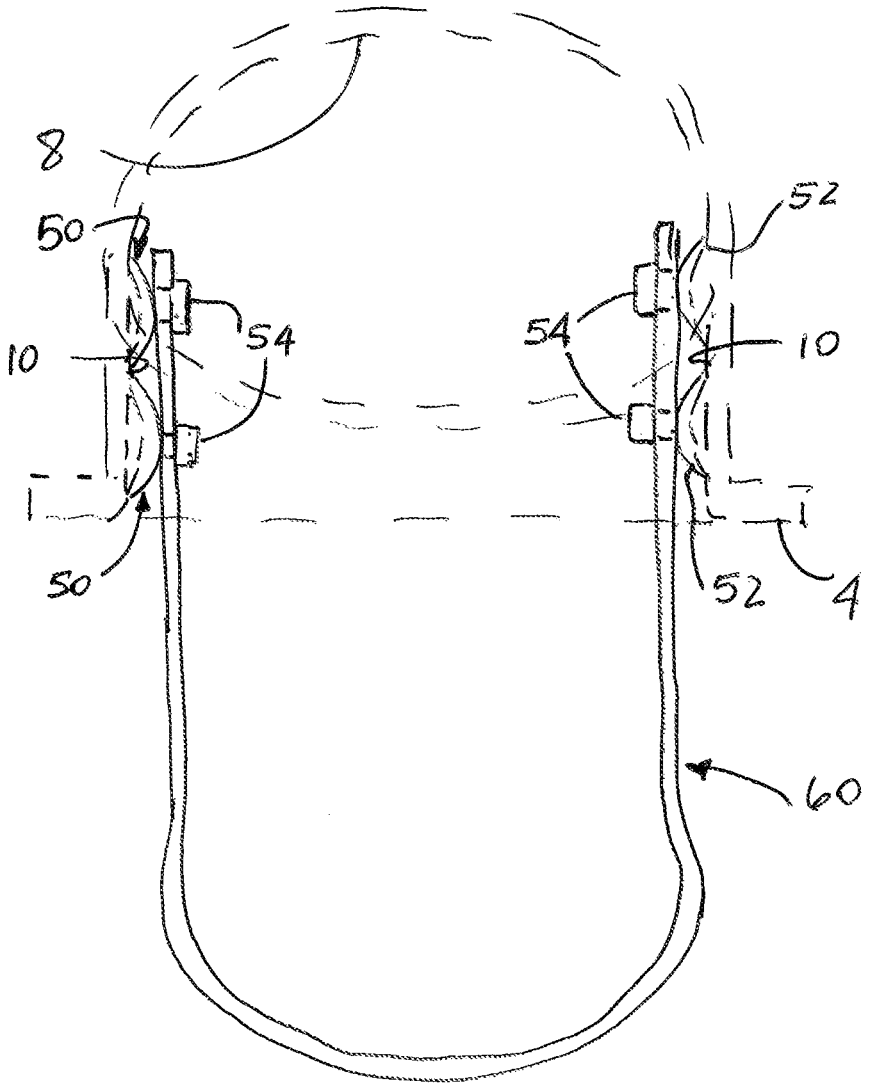
FIG. 14 illustrates a top view of another exemplary embodiment of the flow diverting weir.
Figure 15:
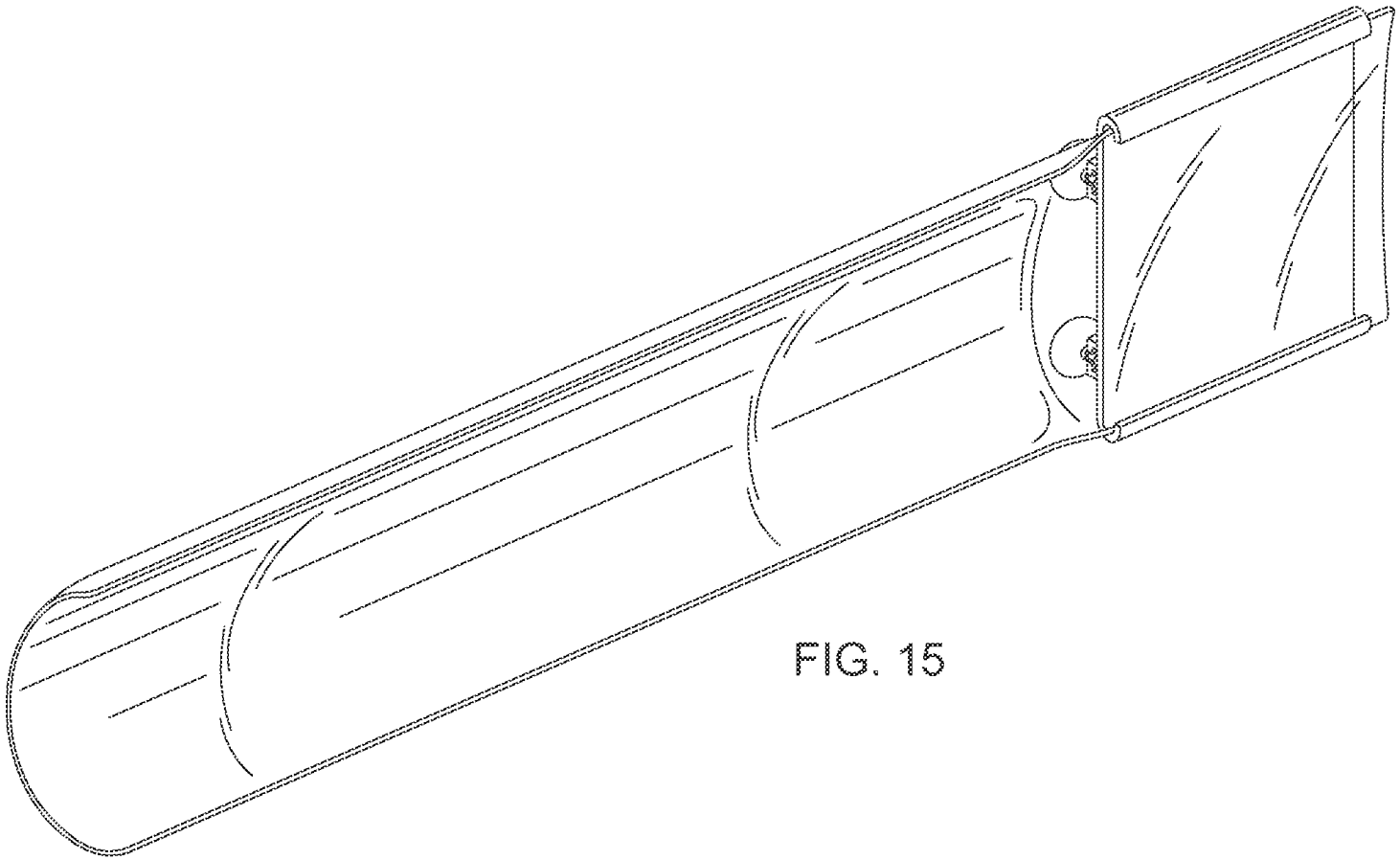
FIG. 15 illustrates a perspective view of the flow diverting weir of FIGS. 4-5 in a fully assembled position including the elongated arm being inserted into the edge flanges of the mounting bracket and suction cups being seated in the channels of the mounting bracket.
Figure 16:
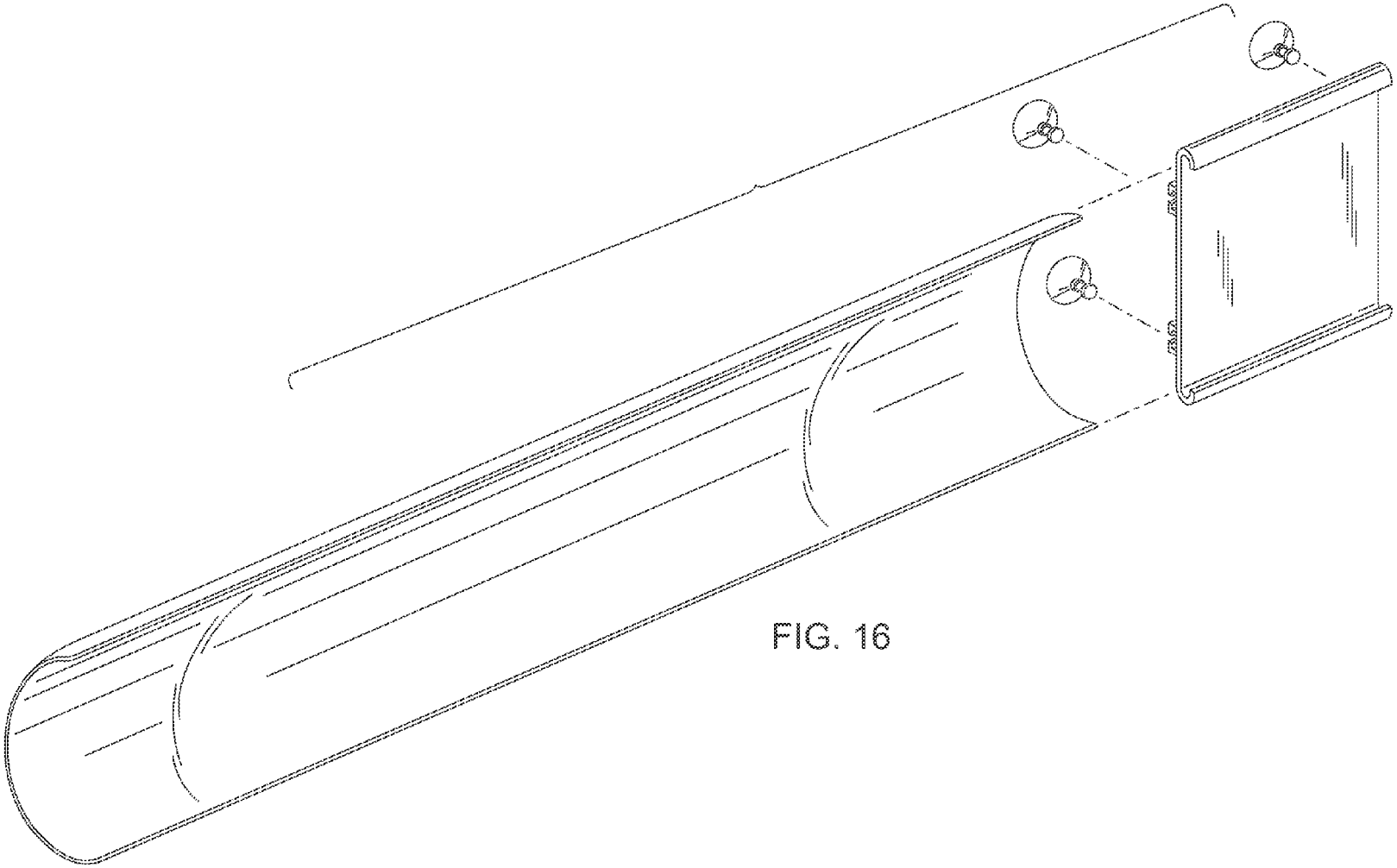
FIG. 16 illustrates an exploded perspective view of the flow diverting weir in FIG. 15.

In another exemplary embodiment, the present disclosure provides a method for preventing ingress of floating debris, for example such as the leaves, small branches and the like, into the skimmer opening 6. FIG. 14 illustrates one example, wherein the method includes the step of inserting both terminal ends of the elongated arm 60 into the skimmer opening 6 so as to abut the opposing surfaces 10, and the step of forming a U-shaped configuration of the elongated arm 60. The method may also include the step of selecting a width of the elongated arm 60 such that the water is allowed to enter the skimmer opening 6 but the floating debris is prevented from ingressing the skimmer opening 6. The method may also include the step of selecting or adjusting a length portion of the elongated arm extending outwardly from the skimmer opening 6 in FIG. 14 by manipulating a length portion of the elongated arm 60 within the opening 6. Although the method is illustrated as using the elongated arm 60 with suction cups 50 on both ends, only one end may be provided with suction cups 50 or both ends may be provided without suction cups 50 in a direct engagement with the vertical surfaces 10 of the skimmer opening 6. In another example, the method may include the step of providing both vertical surfaces 10 with the above described flanges 84 and the step of receiving ends of the elongated arm 60 within the flanges 84. In yet another example, the method may include the step of attaching each end of the elongated arm 60 to the respective vertical surface 10 with suction cup(s) 50 or plug(s) 86 in accordance with the above described examples.

The reader is respectfully requested to note that the elongated arm 60 of the exemplary embodiments of FIG. 1-10, with or without mounting member 30, may be attached to the horizontal surfaces 12 by providing either elongated arm 60 or the mounting member 30 or both with an L-shaped cross-section.

It is contemplated herewithin that only two suction cups 50, spaced apart in a vertical direction, may be selected and/or sized sufficient to maintain the elongated arm 60 in an operative position for either diverting flow of the debris into the skimmer opening 6 or preventing the flow of debris thereinto.

The chosen exemplary embodiments of the claimed invention have been described and illustrated for practical purposes so as to enable any person skilled in the art to which it pertains to make and use the same. It is therefore intended that all matters in the foregoing description and shown in the accompanying drawings be interpreted as illustrative and not in a limiting sense. It will be understood that variations, modifications, equivalents and substitutions for components of the specifically described exemplary embodiments of the invention may be made by those skilled in the art without departing from the spirit and scope of the invention as set forth in the appended claims.

Furthermore, the Abstract is not intended to be limiting as to the scope of the claimed invention and is for the purpose of quickly determining the nature of the claimed invention.

What is claim is:

1. A flow diverting weir device, comprising:

a mounting member comprising at least one suction cup;

an elongated arm manufactured from a flexible material and having one end thereof connected to said mounting member, said elongated arm extendable outwardly from the skimmer opening during use of said flow diverting weir device; and at least one aperture formed through a thickness of said elongated arm; and said at least one suction cup having a base portion thereof being passed through said at least one aperture, said at least one suction cup having a working portion thereof adherable to a vertical surface of the skimmer opening during use of said flow diverting weir device.

2. The flow diverting weir device of claim 1, wherein said mounting member is manufactured from a compressible and resilient material sufficient to cage said mounting member between opposing surfaces of the skimmer opening.

3. The flow diverting weir device of claim 1, wherein said elongated arm includes an arcuate cross-section in a plane normal to a length thereof.

4. The flow diverting weir device of claim 1, wherein said elongated arm is manufactured from a material being sufficiently flexible to wrap around a peripheral surface of said mounting member or follow a curved interior surface of a skimmer basket and being sufficiently resilient to divert floating debris into the skimmer opening while said arm extends outwardly from the skimmer opening.

5. The flow diverting weir device of claim 1, wherein a length of said elongated arm extending outwardly from the skimmer opening during use of said flow diverting weir device is adjustable without use of tools or fasteners.

6. The flow diverting weir device of claim 1, wherein said at least one suction cup is four suctions cups, wherein said at least one apertures is four apertures, two apertures from said four apertures are formed through said thickness of said elongated arm adjacent one end thereof and remaining two apertures from said four apertures are formed through said thickness of said elongated arm adjacent an opposite end thereof.

7. A flow diverting weir device comprising:

an elongated arm manufactured from a flexible material and having one end thereof connected to said mounting member, said elongated arm extendable outwardly from the skimmer opening during use of said flow diverting weir device;

a mounting member comprising a body, a pair of spaced apart flanges disposed on one surface of said body adjacent opposite edges thereof, said pair of spaced apart flanges are shaped to receive a width of said elongated arm therewithin; and at least one suction cup having a working portion for adhering to a surface of the skimmer opening and a base portion releaseably or permanently attachable or attached to said body.

8. The flow diverting weir device of claim 7, further including a pair of channels disposed on an opposite surface of said body in a spaced apart parallel relationship with each other, wherein said at least one suction cup is four suction cups, and wherein base portions of two suction cups are inserted into each channel during use of said flow diverting weir device.

9. The flow diverting weir device of claim 7, wherein said pair of spaced apart flanges and said elongated arm are so sized that said arm is movable into and from the skimmer opening.

10. A flow diverting weir device for diverting floating debris into a skimmer opening of a swimming pool skimmer, comprising:

an elongated arm manufactured from a flexible material and comprising an arcuate cross-section in a plane normal to a length thereof;

one or both ends of said elongated arm being attached or connected to surface(s) of the skimmer opening during use of said flow diverting weir device; and whereby said elongated arm is extendable outwardly from the skimmer opening.

11. A flow diverting weir device for diverting floating debris into a skimmer opening of a swimming pool skimmer, said flow diverting weir device comprising:

a mounting member comprising a pair of telescopically movable portions and a bias member biasing said pair of telescopically movable portions for an engagement with opposite surfaces of the skimmer opening during use of the flow diverting weir device; and an elongated arm comprising a flexible material and one end thereof attached to one of said pair of telescopically movable portions, said elongated arm configured to move between a coiled position, wherein said elongated arm is wrapped around a peripheral surface of said one of the pair of telescopically movable portions and an uncoiled position, wherein said elongated arm extends outwardly from the skimmer opening.

12. The flow diverting weir device of claim 11, wherein said bias member comprises a coil spring.

13. The flow diverting weir device of claim 11, further comprising projections on a terminal surface of each movable portion from said pair of telescopically movable portions.

14. A flow diverting weir device, comprising:

an elongated arm manufactured from a flexible material said elongated arm extendable outwardly from the skimmer opening during use of said flow diverting weir device;

a mounting member comprising at least one suction cup; and said at least one suction cup has a base portion thereof attached to a vertical surface of the skimmer opening and a working portion thereof adhered to a surface of said arm during use of said flow diverting weir device.

15. A flow diverting weir device, comprising:

an elongated arm manufactured from a flexible material said elongated arm extendable outwardly from the skimmer opening during use of said flow diverting weir device;

a mounting member comprising at least one suction cup; and said at least one suction cup has a pair of working portions, wherein one of said pair of working portion is adhered to a surface of said arm and wherein an opposite one of said pair of working portion is adhered to the surface of the skimmer opening during use of said flow diverting weir device.

16. A flow diverting weir device, comprising:

a mounting member engageable with a surface or surfaces of a skimmer opening of a swimming pool skimmer, said mounting member includes a main portion and a pair of resilient elastomeric members terminating opposite ends of said main portion and abutting opposite surfaces of the skimmer opening during use of the flow diverting weir device; and an elongated arm manufactured from a flexible material and having one end thereof connected to said mounting member, said elongated arm extendable outwardly from the skimmer opening, said flexible material is sufficient to move said arm between a coiled position, wherein said elongated arm is wrapped around a peripheral surface of said main portion and an uncoiled position, wherein said arm extends outwardly from the skimmer opening.

17. The flow diverting weir device of claim 16, further comprising projections on a terminal surface of each resilient elastomeric member from said pair of resilient elastomeric members.

18. A flow diverting weir device, comprising:

an elongated arm manufactured from a flexible material and having one end thereof connected to said mounting member, said elongated arm extendable outwardly from the skimmer opening during use of said flow diverting weir device; and a pair of flanges disposed in a spaced apart relationship with each other on a surface of the skimmer opening, said pair of flanges are positioned to receive a width of said elongated arm therewithin during use of said flow diverting weir device.

19. A flow diverting weir device, comprising:

a mounting member comprising a pair of channels disposed in a spaced apart relationship with each other on or within a surface of the skimmer opening;

an elongated arm manufactured from a flexible material and having one end thereof connected to said mounting member, said elongated arm extendable outwardly from the skimmer opening during use of said flow diverting weir device; and two or more suction cups having working portions thereof adhered to a surface of said elongated arm and base portions thereof received within said pair of channels during use of said flow diverting weir device.

* * * * *